US005287672A

United States Patent [19]

Moore

[11] Patent Number: 5,287,672

[45] Date of Patent: Feb. 22, 1994

[54] REINFORCEMENT BAR TRUSSING STRUCTURE AND METHOD OF MAKING THE SAME

[75] Inventor: B. L. Moore, Lebanon, Okla.

[73] Assignee: Oklahoma Steel & Wire Co., Madill, Okla.

[21] Appl. No.: 686,045

[22] Filed: Apr. 16, 1991

[51] Int. Cl.[5] ..... E04C 5/16

[52] U.S. Cl. ..... 52/654.1; 52/655.1; 52/677; 52/741.1

[58] Field of Search ..... 52/677, 309.11, 309.14, 52/650, 655, 648, 309.12, 741, 649.1, 649.8, 654.1, 655.1

[56] References Cited

U.S. PATENT DOCUMENTS

| | | | |
|---|---|---|---|
| 1,750,106 | 3/1930 | Heltzel | 52/677 |
| 2,053,487 | 9/1936 | McLellan | 52/650 |
| 3,471,986 | 10/1969 | Swenson | 52/649.8 |
| 3,890,756 | 6/1975 | Wagner | 52/648 |

*Primary Examiner*—Michael Safavi

*Attorney, Agent, or Firm*—Wood, Phillips, VanSanten, Hoffman & Ertel

[57] ABSTRACT

A reinforcing bar trussing member for maintaining at least two reinforcing bars in a spaced relationship. The reinforcing bar trussing member has an elongate member having at least two opposite ends. Hooks for receiving a portion of the reinforcing bars are preformed at each of the ends of the elongate member. The hooks are deformable to hold the reinforcing bars therein.

4 Claims, 1 Drawing Sheet

REINFORCEMENT BAR TRUSSING STRUCTURE AND METHOD OF MAKING THE SAME

BACKGROUND OF THE INVENTION

1. Technical Field

The present invention is directed toward reinforcing structures for reinforcing concrete moldings and more particularly toward a trussing member for constructing three-dimensional re-mesh structures and a method of building such three-dimensional re-mesh structure.

2. Background Art

The use of trussing members for connecting reinforcing bars is known in the reinforced concrete art. One reinforcing structure incorporating trussing members is known as "MEDICO" produced by Metal Steel Products, Co. The MEDICO structure is a "girder type" reinforcement structure formed by welding an undulating "saw tooth" bar between parallel spaced apart bars at the peak of each saw tooth undulation.

Such structures have numerous shortcomings. First, because the truss members (i.e., the undulating bar) are welded to the parallel spaced apart reinforcing bars, the structure cannot be easily altered in the field. Second, such structures are bulky and relatively difficult to store and transport because they cannot be readily bent or rolled. Lastly, such structures have limited utility in that they are not suitable for use in many three-dimensional concrete moldings because they provide little reinforcing normal to the plane of parallel spaced apart bars.

It is also know in the art to build three-dimensional re-mesh structures by welding diagonally extending "trusses" or wires between parallel, spaced apart re-mesh or welded wire fabric sheets. Once example of such a structure is used in the "Insteel 3-D TM panel" manufactured by Insteel Construction System, Inc. of Brunswick, Ga. In this structure, "truss" bars or wires extend diagonally between parallel wires of the spaced apart re-mesh sheets in the plane defined by the parallel wires of the spaced apart re-mesh sheets. The "truss" wires angularly diverge from each other to form truss-like connections between the re-mesh sheets.

Structures of this type are used principally as a reinforcing frame for wall panels such as the "Insteel 3-D TM panel", and as two layer reinforcing for concrete slabs.

These three-dimensional re-mesh structures have a distinct advantage over the "girder type" reinforcing structures discussed above in that they provide three-dimensional reinforcing. However, these three-dimensional structures also have problems similar to the "girder type" reinforcing structures. For example, the three-dimensional structures cannot easily be altered in the field, they are bulky and they are difficult to transport. In addition, these three-dimensional structures require special care in storing to avoid deforming the structure.

Another embodiment of three-dimensional re-mesh structures known in the art employs an undulating "saw tooth" reinforcing wire welded to parallel but laterally off-set wires of parallel, spaced apart re-mesh sheets. Adjacent undulating reinforcing wires are both welded at their peaks to the same reinforcing wire of the top re-mesh sheet. The undulating reinforcing wires diverge from this top sheet and are welded to wires of the subjacent re-mesh sheet that are adjacent to each other and laterally off-set from the reinforcing wire of the top sheet. This structure may be used in the same manner as three-dimensional structures discussed above.

This structure has an advantage over the structures shown in the "Insteel 3-D TM panel" in that it provides a greater ability to resist forces normal to the plane of the re-mesh sheets; however, it has the same storage and handling problems.

The present invention is directed towards overcoming one or more of the problems discussed above.

SUMMARY OF THE INVENTION

The present invention provides a reinforcing bar trussing member for maintaining at least two reinforcing bars in a spaced relationship having a body with at least two opposite ends. Hooks or U-shaped bends for receiving a portion of the reinforcing bars are preformed at each of the ends of the body. The hooks are deformable to hold the reinforcing bars therein.

The body and the hooks for receiving the reinforcement bars can be integrally formed from a single piece of metal wire having two opposite ends.

Another embodiment of the present invention is a re-mesh trussing system for construction of a three-dimensional wire re-mesh structure. At least two sheets of wire re-mesh are in a parallel-space relationship. A plurality of trussing members extend between the sheets of wire re-mesh. Each trussing member has an elongate portion of predetermined length. The elongate portion has two opposite ends and further includes hooks or U-shaped bends for receiving a portion of the wire re-mesh preformed at each of the ends. The hooks are deformable about a portion of the wire re-mesh to hold and preferably grasp the portion of the wire re-mesh. The elongate metal wire of each trussing member extends perpendicularly from the wire of the re-mesh to which it is attached and preferably obliquely between the adjacent re-mesh sheets to which it is attached. Each of the hooks of each trussing member is deformed about wires of adjacent re-mesh sheets to which it is attached.

The present invention is also directed to a method of configuring concrete reinforcing bars into a concrete reinforcing structure. At least one trussing member is provided having an elongate member of a predetermined length. The elongate member has at least two ends. Hooks or U-shaped bends for receiving the reinforcing bars are preformed at each of the ends of the elongate member. The hooks are deformable about a portion of the reinforcing bar to hold and preferably grasp the portion of the reinforcing bar. Also provided are at least two piece of reinforcing bar. The reinforcing bars are configured into a predetermined structure having at least two reinforcing bars. At least two of the reinforcing bars are connected together by introducing a portion of each of the reinforcing bars to be connected into distinct hooks for receiving of a trussing member. The hooks are deformed about the reinforcing bar portions to grasp the reinforcing bar portions therein.

Yet another embodiment of the present invention concerns a method of configuring wire re-mesh into a three-dimensional re-mesh structure. A plurality of trussing members are provided. Each trussing member is made of an elongate metal wire of a predetermined length. The metal wire has two opposite ends, the two opposite ends being preformed into U-shaped bends or hooks for receiving a portion of wire re-mesh therein. The U-shaped bends are deformable to grasp a portion of the reinforcement wire. At least two of sheets wire re-mesh are provided. The sheets of wire re-mesh are configured into a parallel spaced relationship. Adjacent sheets of wire re-mesh are connected together using the plurality of trussing members. A wire of each re-mesh sheet is inserted into one of the U-shaped bends of each trussing member and each trussing member is positioned to extend perpendicularly from such wires and preferably obliquely between the adjacent re-mesh sheets to which they are connected. The U-shaped bends of each trussing member are deformed about the wire to which it is connected to hold and preferably grasp the wire.

The present invention provides trussing members for constructing reinforcing structures which are easily transported to a construction site. The trussing members are easily manipulated to facilitate the expeditious construction of reinforcing structures, and are held in place by merely deforming their preformed ends about a portion of reinforcing bars to be joined. The trussing members may be deformed by tools readily available at the construction site, including a conventional pair of pliers. The trussing members of the present invention also facilitate the construction of reinforcing structures of different depths simply by using trussing members of varying lengths.

The re-mesh trussing system of the present invention and the method of making the same facilitate field construction of three-dimensional re-mesh structures. Because the three-dimensional structures may be constructed in the field, transportation and storage problems associate with prior art three-dimensional re-mesh structures are eliminated. Re-mesh sheets may be brought to the site in their conventional rolled form without special handling. Three-dimensional re-mesh structures can be quickly and easily assembled in the field by laying out the re-mesh sheets as desired and extending the trussing members between them. Using conventional hand tools such as pliers, hooks of the trussing members can be deformed to grasp wires of the re-mesh sheets and the re-mesh sheets can be reconfigured if necessary using conventional hand tools such as pliers.

Still other aspects, objects and advantages of the present invention will become apparent from a study of the detailed description of the preferred embodiment, the drawings and the appended claims.

DETAILED DESCRIPTION OF THE PREFERRED EMBODIMENT

Figure 1:
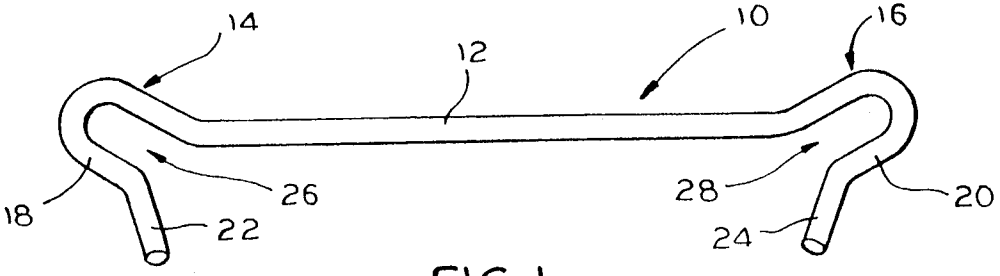
FIG. 1 is a perspective view of a reinforcing bar trussing member of the present invention.

The reinforcing bar trussing member 10 of the present invention is best seen in FIG. 1. An elongate member 12 has two opposite ends 14 and 16. A hook or U-shaped bend 18, 20 for receiving a portion of a reinforcing bar is integrally preformed at each end of the elongate member 12. Tabs 22, 24 each extending at an obtuse angle from an adjacent portion of each hook, are provided at the distal end of the U-shaped bends 18, 20 are provided at the distal ends of the U-shaped bends 18, 20.

The U-shape bends 18, 20 define an entryway/opening 26, 28. The openings 26, 28 should be of a width sufficient to permit the insertion of a reinforcing bar therein. The openings 26, 28 may be of varying size to facilitate joining reinforcing bars of different widths.

The U-shaped bends 18, 20 are deformable for holding and preferably grasping a reinforcing bar therein. Thus, upon inserting a reinforcing bars in the openings 26, 28 the openings may be closed and the U-shaped bends 18, 20 deformed about the reinforcing bars to preferably embrace the reinforcing bars within the deformed U-shaped bends. Alternatively, the openings 26, 28 may be closed with the reinforcing bars being thereby loosely captively held.

The U-shaped bends 18, 20 may be quickly and easily deformed by squeezing the tabs 22, 24 and the elongate member 12 together using any suitable hand tool, including a conventional pair of pliers.

The reinforcing trussing member of the present invention is preferable integrally performed from a single piece of metal wire. In the preferred embodiment, a round piece of metal wire is used, although metal wires of other cross sections may be equally well suited to practicing the present invention.

Figure 2:
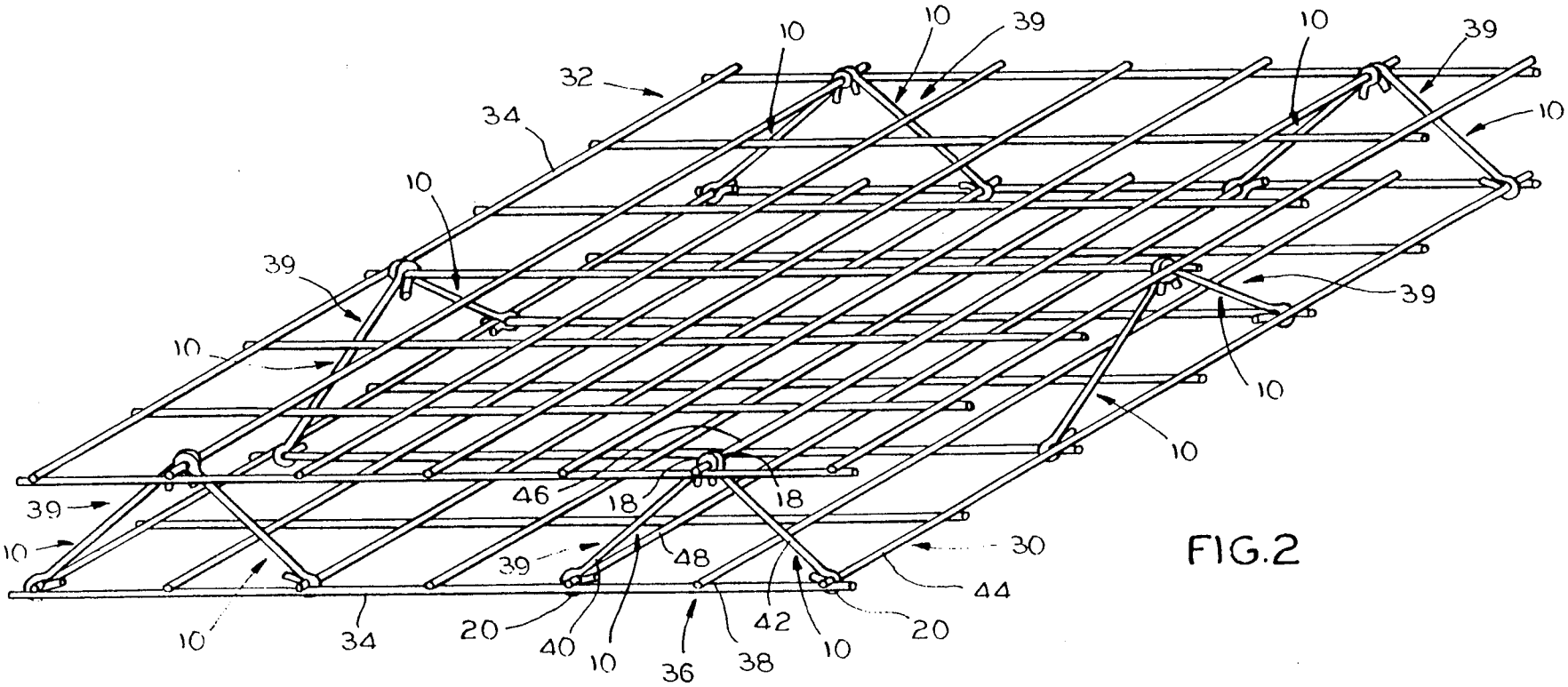
FIG. 2 is a perspective view of a three-dimensional wire re-mesh structure system of the present invention.

A three-dimensional wire re-mesh structure built using the reinforcing trussing bar member 10 of the present invention is illustrated in FIG. 2. A plurality of reinforcing bar trussing members 10 maintain a pair of parallel spaced apart sheets of re-mesh or welded wire fabric 30, 32 in a parallel spaced relationship.

Each wire re-mesh sheet 30, 32 is made of a plurality of reinforcing bars or wires 34 spaced apart and aligned in a square grid pattern. At each intersection 36 of perpendicularly aligned reinforcing wires 34 is a weld 38 holding the individual reinforcing wires 34 in place relative to one another.

In the preferred embodiment of the re-mesh trussing system for constructing a three-dimensional wire re-mesh structure of the present invention, each of the plurality of trussing members 10 extend between the wire re-mesh sheets 30, 32. The trussing members 10 are disposed in pairs 39 including a first trussing member 40 and a second trussing member 42 illustrated in FIG. 2. Each pair of trussing members 39 extend between parallel reinforcing wires, for example, 44, 46 and 48 of FIG. 2. The first trussing member 40 has one of its U-shaped bends deformed to grasp the reinforcing wire 46 of the wire re-mesh sheet 32 The other U-shaped bend 20 of the trussing member 40 is deformed about the parallel but laterally off-set wire 48 of the wire re-mesh sheet 30. Similarly, the U-shaped bend 18 of the second trussing member 42 is deformed about the wire 46 of the re-mesh sheet 32 and other U-shaped bend 20 of the trussing member 42 is deformed about the parallel but laterally off-set wires of the re-mesh sheet 30. Thus, the trussing members 40, 42 extend perpendicularly between parallel but laterally off-set wires of the re-mesh sheets 30, 32 and obliquely between the re-mesh sheets 30, 32. In a similar manner other pairs 39 of trussing members 12 extend between the reinforcing sheets 32, 34 to form the three-dimensional wire re-mesh structure of the present invention.

The wire re-mesh sheets 30, 32 are configured into a three-dimensional re-mesh structure of FIG. 2 by providing a plurality of the trussing members 10. The wire re-mesh sheets 30, 32 are placed in a parallel spaced relationship. The adjacent sheets of wire re-mesh 30, 32 are connected together by the trussing members 10 by inserting a wire 34 of each re-mesh sheet into one of the U-shaped bends 18, 20 of each trussing member 10. The reinforcing bars 34 are inserted into one of the openings 26, 28 in the U-shaped bends 18, 20. The trussing members 10 are located to extend perpendicularly from the wires 34 to which they are connected and obliquely between the adjacent re-mesh sheets 30, 32 to which they are connected. The U-shaped bends 18, 20 are deformed about the wire 34 to which they are attached to grasp the wire. The U-shaped bends 18, 20 are most easily deformed by squeezing the tabs 22, 24 and the elongate portion 12 together by any conventional means, including a pair of pliers.

The trussing members of the present invention are light weight and easily transported to a construction site. The trussing members facilitate quick and easy assembly of two or three-dimensional reinforcing bar structures because they are easy to manipulate and may be deformed to grasp the reinforcing bars by merely deforming their U-shaped bends by many conventional hand tools, including a pair of pliers. The trussing members of the present invention also permit quick and easy modification of reinforcing structures because the deformed U-shaped bends can be easily opened and the trussing members repositioned using conventional hand tools on site. Reinforcing structures of different depths may also be constructed using the inventive trussing members simply by using trussing members of varying length.

The re-mesh trussing system of the present invention and the method of making the same permit field construction of three-dimensional concrete reinforcing structures. By facilitating field construction, handling and storage problems associated with prior art three-dimensional reinforcing structures are eliminated.

I claim:

1. A re-mesh trussing system for constructing a three-dimensional wire re-mesh structure comprising:

at least two sheets of wire re-mesh in a parallel spaced relationship; and a plurality of trussing members, each trussing member including a planar elongate body having a linear elongate center portion of a predetermined length, the elongate center portion having two opposite ends, a U-shaped portion at each end of the center portion defining a reinforcing bar receiving cavity, a first bend defining an obtuse angle between the center portion and each U-shaped portion and a second bend at each end of the body defining a tab at an obtuse angle from the U-shaped portion, whereby the tab diverges from the center portion;

each of the reinforcing bar receiving cavities of each trussing member being deformed about parallel but laterally off-set wires of adjacent re-mesh sheets, the center portion of each trussing member extending perpendicularly from the wire of the re-mesh sheet to which it is attached and obliquely between the adjacent re-mesh sheets to which it is attached.

2. The re-mesh trussing system of claim 1 wherein the body comprises a single piece of metal wire.

3. A re-mesh trussing system for constructing a three-dimensional wire re-mesh structure comprising:

at least two sheets of wire re-mesh in a parallel spaced relationship; and a plurality of trussing members, each trussing member having an elongate portion of a predetermined length, the elongate portion having two opposite ends, the elongate portion further having means for receiving a portion of the wire of the re-mesh preformed at each of the ends, the means for receiving being deformable about a portion of the wire re-mesh to hold the portion of the wire re-mesh;

each of the means for receiving of each trussing member being deformed about parallel but laterally off-set wires of adjacent re-mesh sheets, the elongate metal wire of each trussing member extending perpendicularly from the wire of the re-mesh sheet to which it is attached and obliquely between the adjacent re-mesh sheets to which it is attached, the trussing members being disposed in pairs of first and second trussing members, the means for receiving at one end of both the first and second trussing members being joined to the same wire of a re-mesh sheet and means for receiving at the other end of the first and second trussing members are attached to distinct, laterally off-set wires of the adjacent re-mesh sheet aligned parallel to wire of the re-mesh sheet.

4. A method of configuring concrete reinforcing bars into a concrete reinforcing structure comprising:

a) providing at least one trussing member having a planar body, the body having at least two end, a U-shaped portion at each end of a linear center portion of the body, each U-shaped portion defining a reinforcing bar receiving cavity, a first bend defining an obtuse angle between the center portion and each U-shaped portion and a second bend at each end of the body defining a tab at an obtuse angle from the U-shaped portion, whereby the tab diverges from the center portion;

b) providing at least two pieces of reinforcing bar;

c) configuring at least the two reinforcing bars into a predetermined structure;

d) connecting the at least two reinforcing bars of the structure together by introducing a portion of each of the reinforcing bars into distinct reinforcing bar receiving cavities of the one trussing member;

e) deforming the reinforcing bar receiving cavities of the one trussing member about the reinforcing bar portions to grasp the reinforcing bar portions therein.

* * * * *